US006755358B2

(12) United States Patent
Jaeger

(10) Patent No.: US 6,755,358 B2
(45) Date of Patent: Jun. 29, 2004

(54) ROTOR NOZZLE, IN PARTICULAR FOR HIGH PRESSURE CLEANERS

(76) Inventor: Anton Jaeger, Hofackergasse 3, Senden (DE), D-89250

( * ) Notice: Subject to any disclaimer, the term of this patent is extended or adjusted under 35 U.S.C. 154(b) by 0 days.

(21) Appl. No.: 10/290,084

(22) Filed: Nov. 6, 2002

(65) Prior Publication Data

US 2003/0085303 A1 May 8, 2003

(30) Foreign Application Priority Data

Nov. 7, 2001 (DE) ..... 101 54 509

(51) Int. Cl.[7] ..... B05B 3/16
(52) U.S. Cl. ..... 239/381
(58) Field of Search ..... 239/225.1, 232, 239/251, 252, 255, 263, 380, 381, 389

(56) References Cited

U.S. PATENT DOCUMENTS 4,989,786 A * 2/1991 Kranzle et al. ..... 239/240
5,332,155 A * 7/1994 Jager ..... 239/240
5,598,975 A * 2/1997 Jager ..... 239/237
6,129,293 A * 10/2000 Jager ..... 239/227
6,196,475 B1 * 3/2001 Jaeger ..... 239/381
6,250,566 B1 * 6/2001 Jager ..... 239/237

FOREIGN PATENT DOCUMENTS

| | | | |
|---|---|---|---|
| DE | 4224664 | A1 | 1/1994 |
| DE | 4340184 | A1 | 6/1995 |
| DE | 19703043 | A1 | 7/1998 |
| DE | 29715144 | U1 | 9/1998 |
| DE | 19821919 | A1 | 11/1999 |
| DE | 20103259 | U1 | 7/2001 |
| EP | 0891816 | A2 | 7/1998 |

* cited by examiner

*Primary Examiner*—Denise L. Esquivel
*Assistant Examiner*—Malik N. Drake
(74) *Attorney, Agent, or Firm*—Townsend and Townsend and Crew, LLP

(57) ABSTRACT

A rotor nozzle is described whose rotor body is supported in the housing with a pre-settable axial clearance and whose end facing away from the nozzle is made in conical shape, with the conical surface forming a running surface which cooperates in operation with an axial thrust surface and braking surface fixed with respect to the housing.

10 Claims, 3 Drawing Sheets

ROTOR NOZZLE, IN PARTICULAR FOR HIGH PRESSURE CLEANERS

Figure 1:
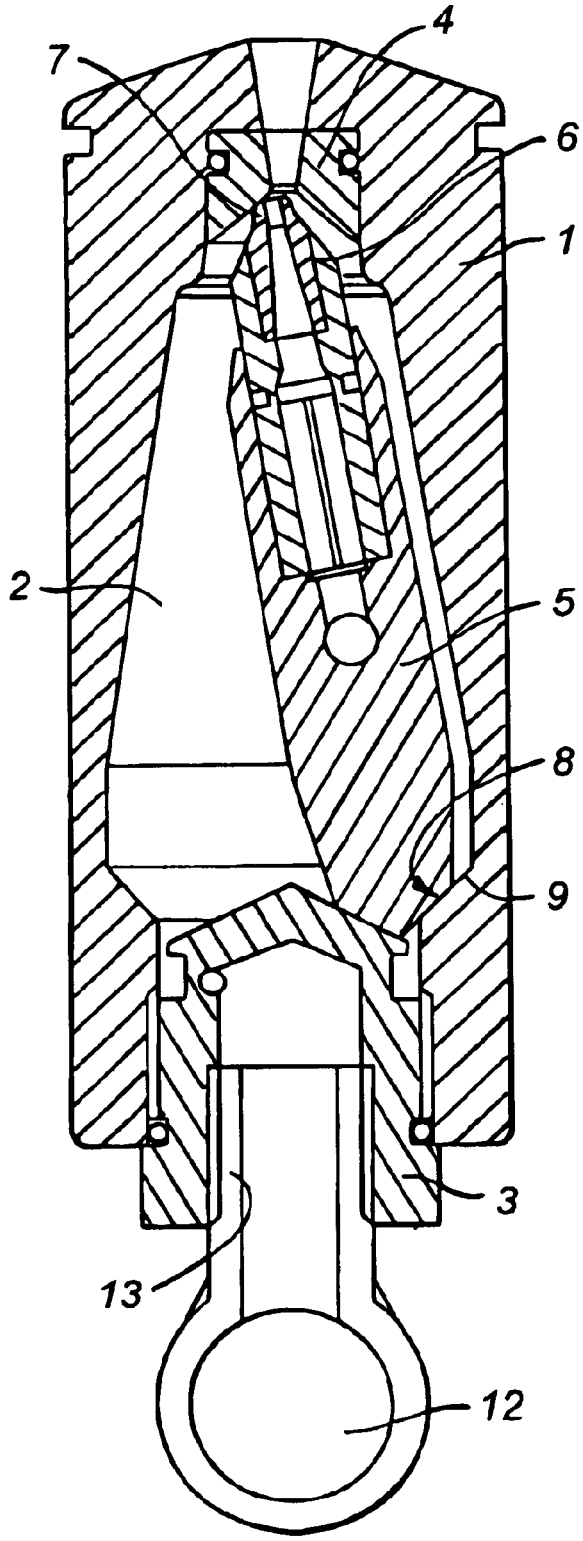

The invention relates to a rotor nozzle, in particular for high pressure cleaners, having a housing with an interior space which is terminated on the inflow side by an input stopper and which has a pan bearing for a nozzle held in a rotor body on the outflow side.

Rotor nozzles of this kind are known and have proven their value in large numbers in practice. However, in particular in connection with specific applications, problems occur over and over again in pre-setting the optimum speed in the individual case for the respective rotor nozzle and simultaneously ensuring that disturbing tendencies to vibration are eliminated.

A rotor nozzle is known from DE 198 21 919 A in which the stopper serves to switch between conical jet operation, on the one hand, and straight jet operation, on the other hand. As a result of the intermediate axial space between the inner body supported at the pan bearing and the outer sleeve engaging with holding arms into recesses of the pan bearing, no bracing of the inner body between the pan bearing and the stopper takes place at any time. The inner body is freely movable in an axial direction and also freely rotatable as a result of this intermediate space in the outer sleeve. The pivotability of the inner body relative to the outer sleeve is also absolutely necessary since otherwise lateral braking forces would occur which would be too high and which could result in rapid wear of the holding arms of the outer sleeve.

It is the object of the invention to develop a rotor nozzle of the kind initially set forth in a manner such that interruptions to operation due to foreign bodies, in particular due to foreign bodies becoming active at the nozzle start-up, can be avoided, on the one hand, and defined speeds can be pre-set, on the other hand, with furthermore tendencies to vibration being eliminated by construction measures.

This object is substantially satisfied in accordance with the invention by the features of claim 1.

It is ensured by the clearance adopted between the nozzle tip and the pan bearing in the idle state that any soil particles possibly present between the nozzle head and the bearing in the start-up phase can be reliably washed out.

It is achieved by a suitable choice of the angle of the cone for the running surface provided at the end of the rotor body and for the axial thrust surface and braking surface cooperating therewith and fixed with respect to the housing that a defined stroke movement of the rotor body in the direction of the pan bearing takes place in the course of the start-up phase, on the one hand, and a relevant braking power is achieved in operation in the cooperation between the running surface and the braking surface, on the other hand. A bracing between the inclined surfaces, the rotor body and the pan bearing furthermore results in operation due to the cooperating inclined surfaces, whereby disturbing vibrations can be reliably eliminated.

The axial thrust surface and braking surface fixed with respect to the housing can form a radially inner partial running surface and a radially outer partial running surface adjoining it for the rotor body for the purpose of setting different speeds, with the angle of inclination of the radially outer partial running surface preferably being larger than the angle of inclination of the radially inner partial running surface. With this embodiment, the pan bearing can, for example, be axially adjustable in order to be able to set the different speeds.

Further advantageous aspects of the invention are recited in the dependent claims.

Figure 2:
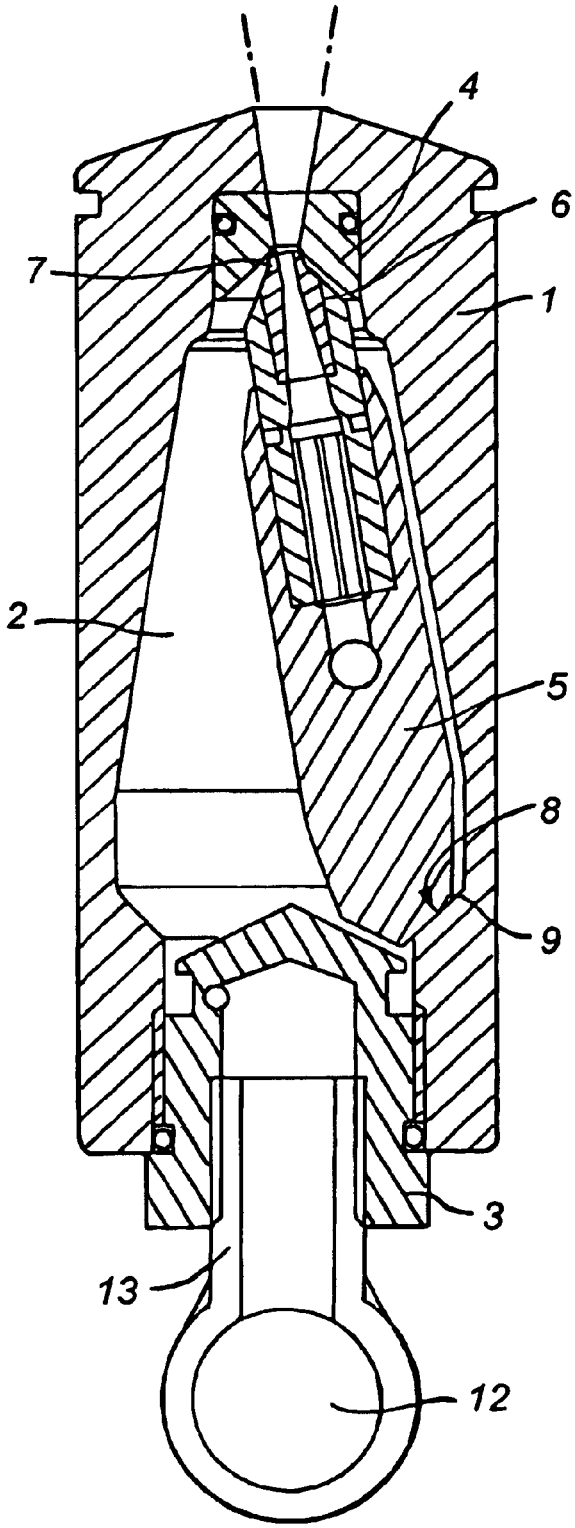

An embodiment of the invention will be explained in the following with reference to the drawing, in which are shown:

FIG. 1 a schematic cross-sectional representation of a rotor nozzle in accordance with the invention in the starting position;

FIG. 2 the rotor nozzle of FIG. 1 during normal operation; and

Figure 3:
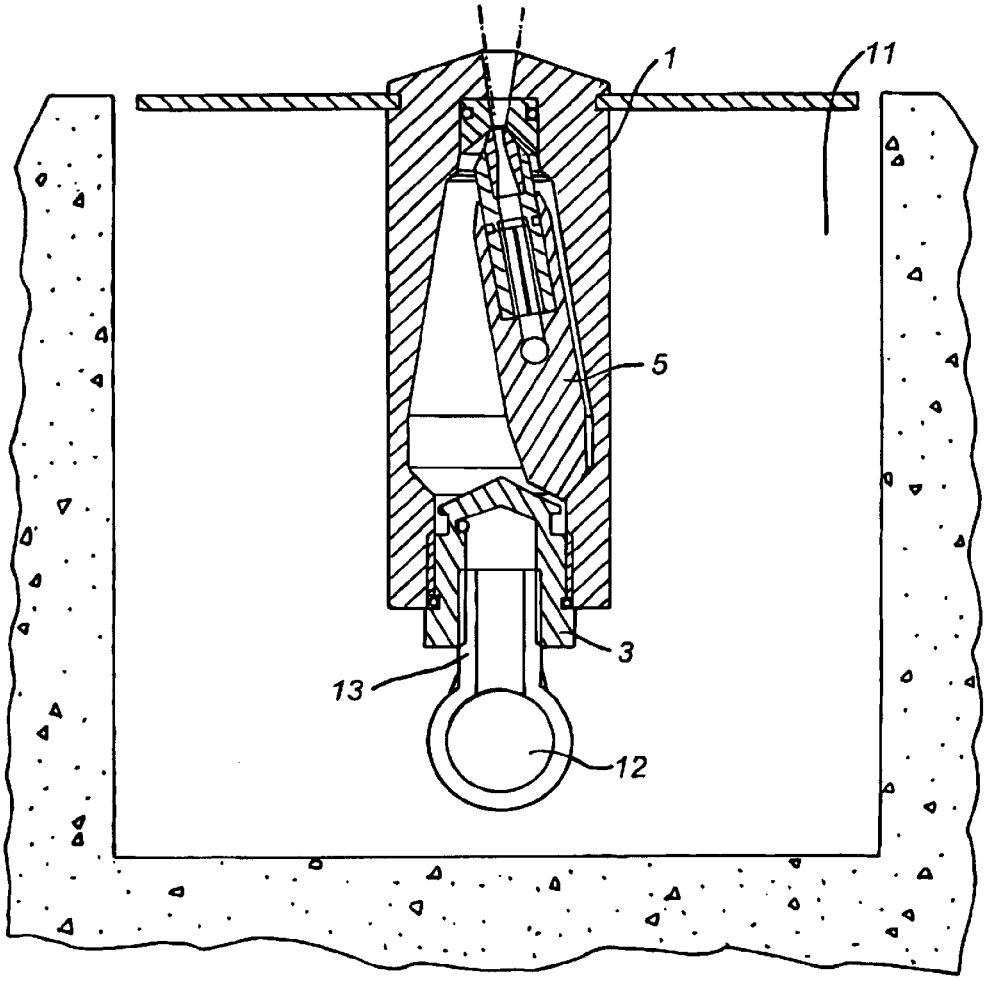

FIG. 3 the nozzle of FIG. 2 arranged in the ground channel of a carwash plant.

FIG. 1 shows a rotor nozzle arranged in a standing position and comprising a housing 1 in whose inner space 2 a rotor body 5 is arranged which supports a nozzle 6. This nozzle 6, to which the working fluid is supplied via a corresponding bore in the rotor body 5, cooperates with a pan bearing 4 provided on the output side. An input stopper 3 is screwed to the housing 1 on the inflow side and is connected to a supply pipe 12 via a weld-on nipple 13 in this case. The working fluid is supplied to the inner space 2 of the housing in the customary manner with such rotor nozzles such that it starts to rotate in the housing space and moves the rotor body 5 along with it.

The input stopper is formed in a shallow conical manner with respect to the inner space 2 of the housing such that the rotor body 5 also adopts an inclined position with respect to the longitudinal axis of the housing in the idle state. This does not represent a necessary requirement.

As can be seen from FIG. 1, the rotor body 5 is supported in the inner space 2 of the housing with a clearance adopted between the nozzle tip 7 and the pan bearing 4 in the idle state, that is the nozzle tip 7 is located outside of its desired position in the pan bearing 4. This ensures that soil particles located in the bearing region in the start-up phase can be washed out without causing a disturbance or damage to the bearing.

The rotor body 5 is conical in shape at its end facing away from the nozzle 6 and the corresponding conical surface 8 forms a running surface which cooperates in operation with an axial thrust surface and braking surface 9 fixed with respect to the housing.

The cone angle at the rotor end preferably lies in the range from 30° to 50°, with an adequate stroke movement in the direction of the pan bearing 4 also already being able to be achieved from a cone angle of 25° in the start-up phase.

A relevant braking power is reached from a cone angle from approximately 30°, which corresponds to an apical angle with respect to the total cone of 60°. The preferred angle with respect to the desired braking effect lies in the range from 65° to 135°, with these values relating to the apical angle of the total cone.

The inclination of the axial thrust surface and braking surface 9 is correspondingly matched to the associated cone angle.

When the rotor nozzle moves from the position shown in FIG. 1 into the start-up phase, the rotor body 5 is axially displaced due to the coming into effect of the inclined surface such that the nozzle tip is moved to its desired position in the pan bearing 4. This operating state is shown in FIG. 2.

In accordance with FIG. 2, which represents the normal operating phase, the rotor body 5 runs via its conical surface 8 on the braking surface 9 of the housing 1 and is pressed against this due to the centrifugal force which comes into effect, with an areal contact, but also a linear contact, being able to take place or be selected. The speed is pre-set by the pressing of the rotor onto the braking surface 9 which is adopted. The rotor body 5 itself as a rule consists of plastic, whereas the housing 1 is made of metal.

The inclined surface 9 on the housing accordingly has a dual function in that it presses the nozzle 6 into the pan bearing 4, on the one hand, and brakes the rotor body 5 in accordance with the selected inclination and, in the embodiment selected in the shown example, prevents the rotor body 5 from coming into contact with the housing wall, on the other hand; that is there is always a gap present between the rotor body 5 and the inner wall of the housing 1.

For the event that different speeds should be made possible for the purpose of matching to certain cleaning jobs, the braking surface 9 can be provided with differently inclined partial braking surfaces which succeed one another in the radial direction, with the pan bearing in this case preferably being axially adjustable for the purpose of setting the speed.

Although the rotor nozzle in accordance with the invention can be used in all typical applications of such rotor nozzles and can also be used, for example, in connection with a cleaning gun, this rotor nozzle is preferably used as an underbody nozzle in carwash plants. This application is shown in FIG. 3 where the rotor nozzle is arranged in a ground channel 11 in which a supply pipe 12 extends which feeds a plurality of such nozzles via connection nipples 13.

Reference Numeral List

1 housing
2 inner space of the housing
3 input stopper
4 pan bearing
5 rotor body
6 nozzle
7 nozzle tip
8 conical surface
9 axial thrust surface and braking surface
11 ground channel
12 supply pipe
13 connection nipple

What is claimed is:

1. A rotor nozzle, in particular for high-pressure cleaners, comprising a housing (1) having an inner space (2) which is terminated on the inflow side by an input stopper (3) and has a pan bearing (4) for a nozzle (6) held in a rotor body (5) on the outflow side, characterized in that the rotor body (5) is supported in the inner space (2) of the housing with a clearance adopted between a tip (7) of the nozzle (6) and the pan bearing (4) in the idle state such that a defined stroke movement of the rotor body (5) takes place in the direction of the pan bearing (4) in the start-up phase;

in that the rotor body (5) is conical in shape at its end opposite the nozzle (6) and this conical surface (8) of the rotor body (5) forms a running surface; and in that the conical surface (8) of the rotor body (5) cooperates in operation with an axial thrust surface and braking surface (9) on the housing side which is fixedly arranged with respect to the housing at least in the axial direction and which exerts both an axial thrust function and a braking function for the rotor body (5) such that the rotor body (5), which adopts an increasingly inclined position in the start-up phase, undergoes an axial thrust by the axial thrust surface and braking surface (9) and thereby carries out the stroke movement in the direction of the pan bearing (4);

that, after the carrying out of the stroke movement, a bracing of the rotor body (5) between the axial thrust surface and braking surface (9) and the pan bearing (4) occurs due to the increasing axial thrust, which prevents disturbing vibrations of the rotor body; and simultaneously a braking power is achieved for the rotor body (5) due to the cooperation between the conical surface (8) of the rotor body (5) and the axial thrust surface and braking surface (9) of the housing (1) by which the speed of the rotor body (5) is limited to a maximum value.

2. A rotor nozzle in accordance with claim 1, characterized in that the axial thrust surface and braking surface (9) is formed by a conical ring surface provided at the housing.

3. A rotor nozzle in accordance with claim 1, characterized in that the input stopper (3), which is in particular axially adjustable, is made in arched shape, in particular in a shallow cone shape, with respect to the inner space (2) of the housing (1) for the purpose of inclining the rotor body (5) in the idle state.

4. A rotor nozzle in accordance with claim 1, characterized in that the clearance between the nozzle tip (7) and the pan bearing (4) lies in the region from 1 to 3 mm in the idle state.

5. A rotor nozzle in accordance with claim 1, characterized in that, over its radial extent, the axial thrust surface and braking surface (9) has at least two different inclinations with respect to the longitudinal axis of the housing.

6. A rotor nozzle in accordance with claim 5, characterized in that the axial thrust surface and braking surface (9) includes a radially inner partial running surface and a radially outer partial running surface adjoining it, with the angle of inclination of the radially outer partial running surface being larger than the angle of inclination of the radially inner partial running surface.

7. A rotor nozzle in accordance with claim 1, characterized in that the cone angle at the rotor end lies in the range from approximately 20° to 70°, in particular in the range from 30° to 50°.

8. A rotor nozzle in accordance with claim 7, characterized in that the angle of inclination of the axial thrust surface and braking surface (9) with respect to the longitudinal axis of the housing lies in the range from approximately 20° to 70°, in particular in the range from 30° to 50°.

9. A rotor nozzle in accordance with claim 8, characterized in that the angle of inclination of the axial thrust surface and braking surface (9) in each case corresponds at least substantially to the respective cone angle at the rotor end.

10. Use of a rotor nozzle in accordance with claim 1 as an underbody nozzle arranged at least substantially in a standing position in carwash plants.

* * * * *